United States Patent [19]

Anderson

[11] 4,455,711

[45] Jun. 26, 1984

[54] HINGE HAVING A LATERALLY OUTWARDLY EXTENDING FLAT SPRING

[75] Inventor: John P. Anderson, Ontario, Calif.

[73] Assignee: Hartwell Corporation, Placentia, Calif.

[21] Appl. No.: 284,922

[22] Filed: Jul. 20, 1981

[51] Int. Cl.[3] ..... E05D 7/10

[52] U.S. Cl. ..... 16/229; 16/258; 16/262; 16/380; 16/386

[58] Field of Search ..... 16/229, 257, 258, 259, 16/262, 263, 270, 380, 386

[56] References Cited

U.S. PATENT DOCUMENTS

| | | | |
|---|---|---|---|
| 2,186,789 | 1/1940 | Rosenberg | 16/229 |
| 3,908,227 | 9/1975 | Cain | 16/229 |
| 4,178,657 | 12/1979 | Way, Jr. | 16/229 |

FOREIGN PATENT DOCUMENTS

| | | | |
|---|---|---|---|
| 784405 | 5/1968 | Canada | 16/386 |
| 1338240 | 8/1963 | France | 16/386 |

OTHER PUBLICATIONS

"Kwik! Release Hinge Assemblies", Burklyn Hinge Division of the Hartwell Corporation, numbered here as pp. 1–4, published prior to Jul. 20, 1980.

Drawings of Various Hinges, Manufactured and Sold by the Hartwell Corporation, numbered here as pp. 5–11, sold prior to 7/20/81.

*Primary Examiner*—Fred Silverberg

*Attorney, Agent, or Firm*—Lyon & Lyon

[57] ABSTRACT

A quick release hinge/latch for removably attaching two surfaces including a keeper adapted to attach to a surface and having an edge portion in the form of a hollow keeper tube, a housing adapted to attach to another adjacent surface and also having an edge portion in the form of a hollow housing tube such that the keeper tube and housing tube fit together to form an extended tube, a pin which slides within the extended tube to detachably connect the keeper and housing and a flat spring/actuator which attaches to the pin through an opening in the housing tube. The spring/actuator when in a first position holds the pins partially extended into the keeper tube. When the leg portions of the spring/actuator are pinched together and into a second position the pin is withdrawn from the keeper tube. The pinched spring/actuator can then be rotated about the housing tube axis into a third position where the spring-/actuator locks into a radial opening in the housing tube to thereby lock the pin entirely within the housing tube allowing easy detachment of the housing from the keeper. The spring/actuator is shown in preferred embodiments as a C- or W-shaped flat spring.

30 Claims, 17 Drawing Figures

HINGE HAVING A LATERALLY OUTWARDLY EXTENDING FLAT SPRING

BACKGROUND OF THE INVENTION

A large market exists for hinges and latches. Such a market includes a demand for hinges and latches that will attach to doors or panels and which will allow rapid detachment or replacment of doors, panels, modules and printed circuit boards as well as quick access to closed-off areas.

Many of the existing hinges and latches are not capable of being made entirely from non-metallic materials. Thus, they may have conductive metal parts which risk contacting electrical wiring or which corrode or which weigh too much for some applications. Many existing hinges and latches also require an awkward number of assembly steps. Further, the relatively large number of components of some hinges and latches create problems of reliability, inventory records, and storage space.

SUMMARY OF THE INVENTION

By this invention a hinge/latch is provided which will allow for rapid and detaching of two adjacent surfaces.

A further object of this invention is to provide a quick release hinge/latch device which is capable of being made entirely from non-metallic materials to thereby reduce electrical, corrosion and weight problems.

A still further object of this invention is to provide a quick release hinge/latch device which can be assembled in a relatively small number of steps.

A still further object of this invention is to provide a quick release hinge/latch device which has a relatively small number of components to thereby minimize reliability and storage problems.

A still further object of this invention is to provide a quick release hinge/latch device comprising a housing adapted to attach to a first surface and having an edge portion in the form of a hollow tube or tubes said tube(s) having an axial opening with a radial portion or portions, a pin or pins for sliding within and partially beyond said tube or tubes, a flat spring with two leg portions which is partially outside said tube or tubes and which attaches to one end of each pin communicating thereto through the axial opening. When the flat spring is at rest in a first position it holds the pin or pins in extension partially beyond the housing tube(s) such that said pin(s) removeably connect to a second surface either directly or by means of a keeper attached to the second surface said keeper having a tube portion adapted to receive said pin(s). When the spring leg portions are pressed toward each other to a second position the pin(s) are thereby pulled entirely into the housing tube(s) to detach the housing from said second surface. The spring can also be rotated about the housing tube axis to a third position with the spring leg portions communicating with the pin or pins through the radial portion(s) of the axial opening to thereby hold the pin(s) retracted entirely within the housing tube(s).

A still further object of this invention is to provide serrated edges on the surface of the leg portions of the spring to aid in moving said spring into various positions.

IN THE DRAWINGS

DETAILED DESCRIPTION

Figure 1A:
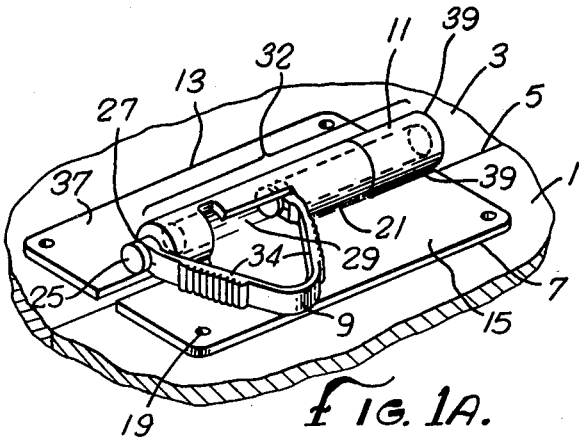
FIGS. 1A, 1B and 1C are side elevational views of an exemplary version of the invention.

Referring now to FIGS. 1–4, a first preferred embodiment of the quick release hinge/latch is shown. The invention in environment is shown in FIG. 1A, the environment consisting of a first surface 1 adjacent to a second surface 3 thereby forming a surface edge 5.

The invention as shown in FIGS. 1–4 includes a housing 7, a spring/actuator 9, a pin 11 and a keeper 13. These pieces may be made from plastic.

The housing 1 as shown in FIGS. 1–4 consists of a substantially flat rectangular base portion 15 which rests on the first surface 1 and attaches to said surface by, for example, screws through holes 19 in said rectangular base portion 15, and an edge portion in the form of a hollow housing tube 21. Said housing tube 21 is located near and parallel to the surface edge 5 when the housing 7 is attached to said first surface 1. The hollow housing tube 21 has one open end 23 and one end 25 with a radial groove 27 in its exterior surface. The housing tube 21 further has an external lateral opening with an axial portion 29 and a radial portion 31.

The pin 11 slides within the hollow housing tube 21. One end, the housing end 30, of the pin 11 has a radial groove 33 in its exterior surface.

The spring/actuator 9 is a C-shaped flat spring with two leg portions 34 each with a foot in the form of clipping jaws 35. The outer surface of the spring/actuator 9 is serrated to allow for easy gripping of the spring/actuator.

The keeper 13 comprises a flat rectagular base portion 37 and a keeper hollow tube 39 on an end of an edge portion of the keeper 13. The keeper hollow tube 39 fits next to the end 23 of the housing tube 21 and in alignment with a housing tube axis to thereby form an extended hollow tube 32 when the keeper 13 is attached to a second surface 3 said keeper 13 being attached such that it is parallel to the housing 7 and adjacent to said housing 7 across the surface edge 5.

To easily and quickly assemble the invention one slides the pin 11, the housing end 30 with the radial groove 33 being slid in first, into the hollow housing tube 21 via the open tube end 23. One jaw 35 of the spring/actuator is removably snapped onto the radial groove 33 of the pin 11, a portion of the spring/actuator passing through the opening 29 in said tube 21. The other jaw 35 of the spring/actuator is removeably snapped onto the radial groove 27 on the end 25 of the housing tube 21. The invention at such a point in time will consist of an assembly as in FIG. 3 having the housing 7 and the pin 11 connected by the spring/actuator 9 and a separate keeper piece 13 shown in FIG. 2. The pin 11 is held in partial extension beyond the end 23 of the housing tube 21 by the spring/actuator 9. The extended end of the pin 11 can be slid into the hollow keeper tube 39 as in FIG. 4 and the housing base portion 15 attached to a first surface and the keeper base portion 37 attached to a second surface.

The assembly steps can, of course, be varied and the invention can also be disassembled by reversing assembly steps. Either the keeper or housing, or both, can be an integral portion of said first or second surfaces without changing the nature of this invention, in this or any other embodiment of the invention.

Figure 1B:
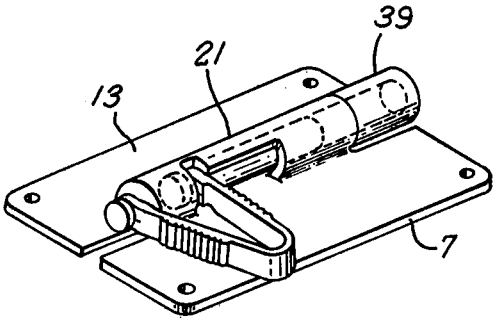
Figure 1C:
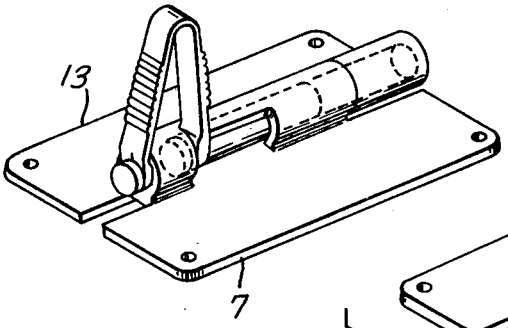
Figure 2:
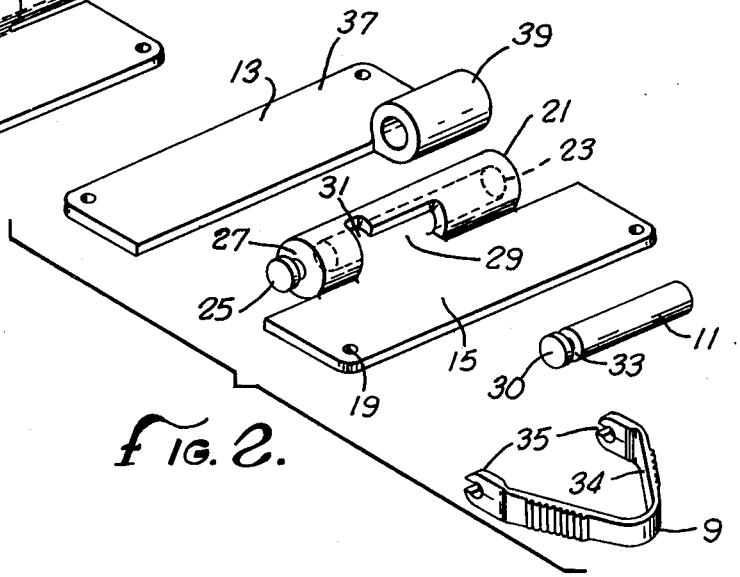
FIG. 2 is an exploded view of the components of the same exemplary version of the invention.
Figure 3:
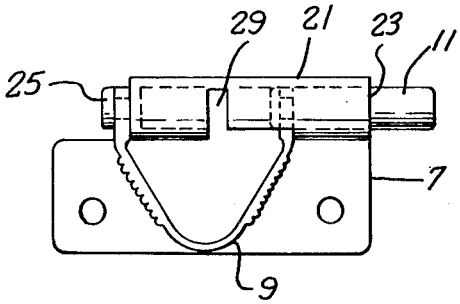
FIG. 3 is an elevational view of the same exemplary version of the invention.
Figure 4:
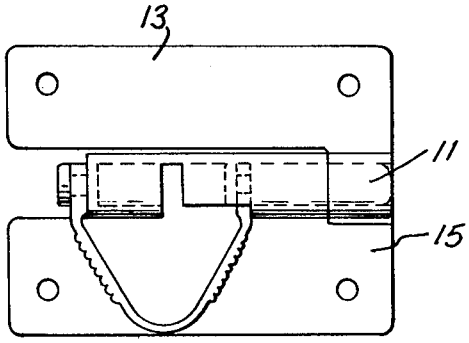
FIG. 4 is an elevational view of the same exemplary version of the invention further including a keeper.
Figure 5:
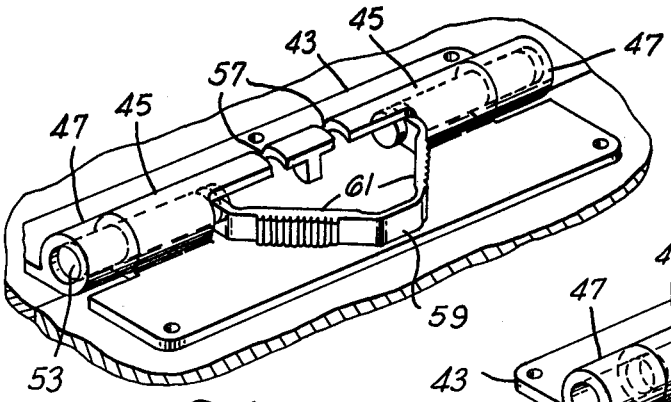
FIGS. 5, 5B and 6 are side elevational views of a second exemplary version of the invetion.

Use of the invention is illustrated by FIGS. 1A, 1B and 1C. The spring/actuator 9 in FIG. 1A is in a first position resting substantially on the housing base portion 15. The spring/actuator 9 is in compression with one foot 35 detachably snapped over the radial groove 27 and thereby anchored to the end 25 of the housing tube and with the other foot 35 end detachably snapped over the radial groove 33 on the housing end of the pin 11. The expansion force of the spring/actuator 9 pushes the pin 11 partially out of the housing tube 21 and partially into the keeper tube 39 thereby attaching the first and second surfaces. In this first position a portion of a leg portion of the spring/actuator 9 rests in the axial portion 29 of the lateral housing opening at an extreme end of said axial portion.

The first position is a stable configuration as the spring/actuator is prevented from rotating about the housing tube axis because it comes into contact against either an edge of the housing tube above the axial opening 29 or against the housing base portion 15. The spring/actuator does not move along the housing tube axis because the portion of the leg portion pushes against and rests against an edge of the housing tube at the extreme end of the axial opening 29. The pin 11 attached to the spring/actuator 9 is also held in stable extended position thereby latching the first and second surfaces together. The pin 11, being cylindrical can also serve as a pivot pin. The keeper tube 39 which fits around the end of the pin 11 can rotate about an axis through the center of the pin, thereby making the invention serve as a hinge.

To detach the first and second surfaces 1 and 3 one grasps the spring/actuator 9 between one's thumb and forefinger and then one pinches the leg portions 34 of the spring/actuator together. This pulls the pin 11 entirely back into the housing tube 21 thereby disconnecting the end of the pin 11 from the keeper tube 39. When the spring/actuator 9 is in this pinched second position as shown in FIG. 1B the keeper 13 and housing 7 are entirely disconnected.

To maintain the keeper and housing detached the pinched spring/actuator 9 is rotated roughly 90° into a third position as shown in FIG. 1C. The portion of the leg portion 34 of the spring/actuator 9 that rested in the axial portion 29 of the lateral opening now rests within the radial portion 31 of said opening. The radial portion 31 has a relatively narrow dimension along the housing tube axis compared to such dimension of the axial portion. Thus, when one releases the spring/actuator 9 said portion of the leg portion quickly abuts against an edge of the housing tube 21 thereby keeping the pin 11 locked entirely within the housing tube 21. The keeper 13 and housing 7 can now be easily separated as can the first and second surface 1 and 3 to which they are attached.

A second preferred embodiment of the invention is shown in FIGS. 5–10. This embodiment is very similar to the first such embodiment in structure and operation.

As shown in FIGS. 5 through 8 a housing 41 attaches to a first surface and a keeper 43 attaches to a second surface. The housing 41 has an edge portion in the form of a hollow housing tube 45. The keeper 43 has two edge end portions in the form of hollow keeper tubes 47. The keeper tubes 47 fit against each end of the housing tube 45 to form one extended hollow tube 48. A pin 49 slides within each half-end of this hollow tube. These pins 49 are of such length that each may fit entirely within one-half of the housing tube 45. Each pin 49 has two ends, a spring/actuator end 51 and a keeper end 53. The spring/actuator end 51 has a radial groove 52 in its exterior surface.

The housing tube 45 further has a lateral opening with an axial portion 55 and two radial portions 57.

Figure 7:
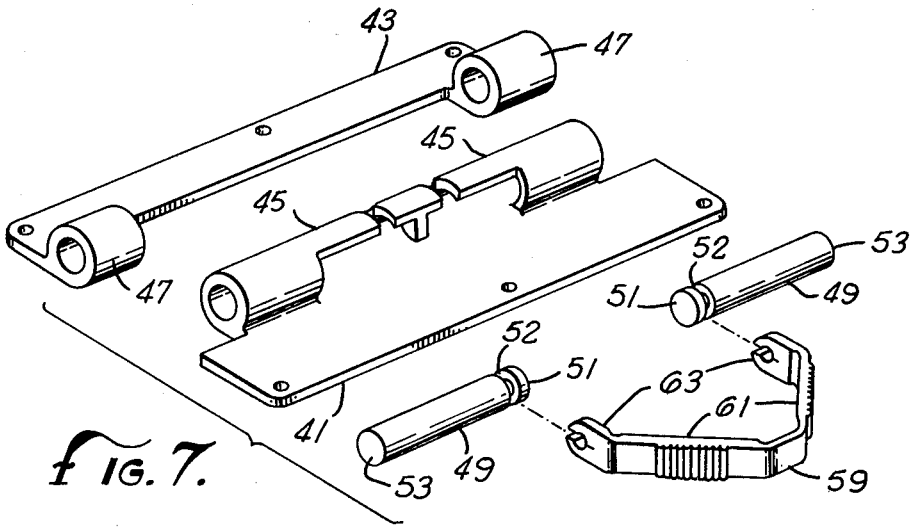
FIG. 7 is an exploded view of this second exemplary version.
Figure 14:
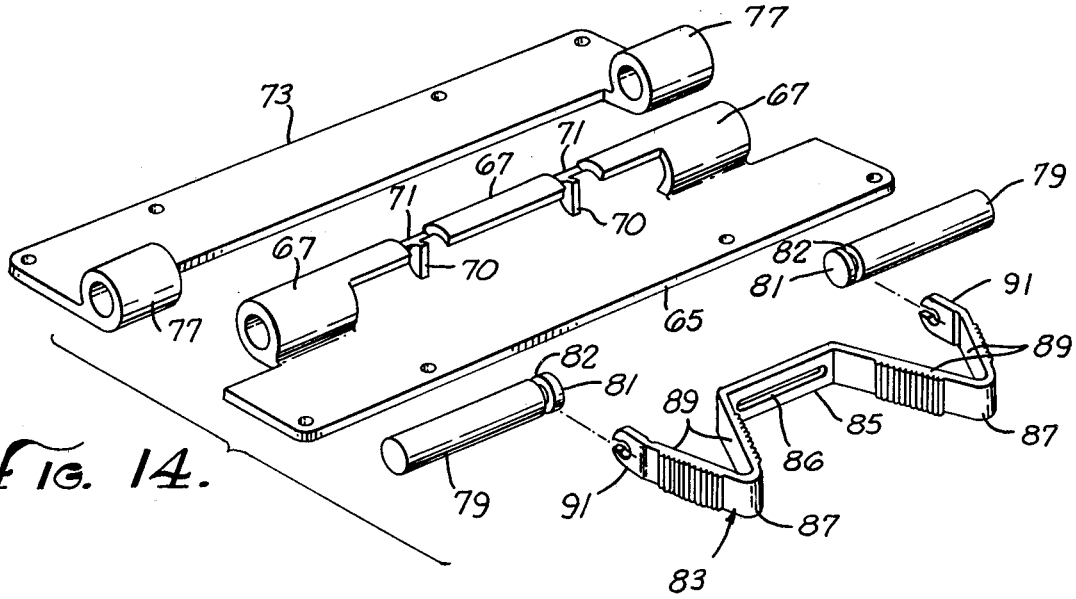
FIG. 14 is an exploded view of this third exemplary version.

This second preferred embodiment of the invention further has a spring/actuator 59 of the same structure as in the first embodiment. The spring/actuator as shown in FIG. 7 is C-shaped with two leg portions 61 which end in feet in the form of clipping jaws 63. The outside surface of the spring/actuator is serrated for better gripping.

Figure 8:
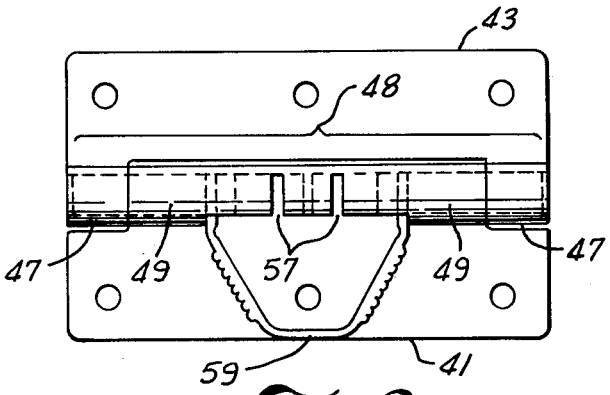
FIG. 8 is an elevational view of this second exemplary version.
Figure 10:
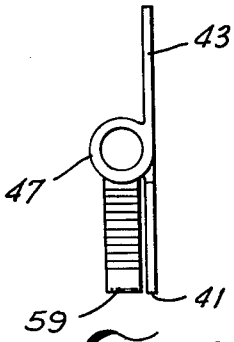
FIG. 10 is an end view of this second exemplary version.
Figure 9:
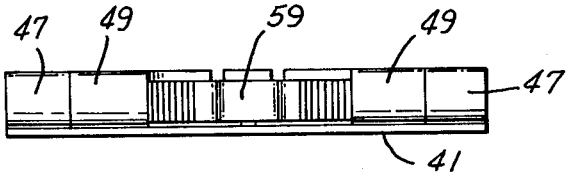
FIG. 9 is a side view of this second exemplary version.

To assemble this preferred embodiment, the spring/actuator end 51 of each pin 49 is slid into each end of the housing tube 45. The feet 63 of the spring/actuator are pushed through the lateral opening in the housing tube 45 and are clipped onto the grooves 52 on the spring/actuator ends 51 of the pins 49 as in FIG. 5. The spring/actuator leg portions 61 are pinched toward each other pulling the pins 53 entirely into the housing tube 45. The keeper 43 is fitted together with the housing 47 such that the keeper tubes 47 fit against the ends of the housing tube 45 to form one extended tube 48. The spring/actuator 59 is released. It spreads apart sliding the pins 53 partially into each keeper tube 47 as shown in FIG. 8.

This second preferred embodiment operates quite similarly to the first preferred embodiment except that there are two pins. When the spring/actuator is in a first position as in FIG. 5 or 8 the leg portions of the spring/actuator 59 are spread by the spring expansion force of the spring/actuator 59 until a portion of each leg portion 61 abuts against an edge of the housing tube 45 at each end of the axial portion 55 of the lateral opening of the housing tube. The attached pins 49 are thereby extended partially beyond each end of the housing tube 45 and partially into respective keeper tubes 47.

The keeper 43 and housing 41 are thus latched together and through them any surfaces to which they are attached. The axial portion 55 of the lateral housing tube is narrow thus preventing the spring/actuator 59 from rotating about an axis through the housing tubes. The pins 49 are thus held in a stable position. The keeper tubes 47 which fit around the keeper ends 53 of the pins 49 can rotate about an axis through said pins allowing the invention to serve as a hinge.

Figure 5B:
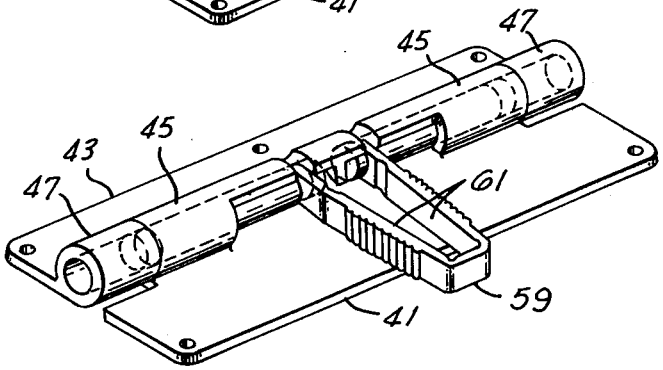

By pinching the leg portions 61 of spring/actuator 59 together into a second position (as in FIG. 5B) the pins are pulled back entirely into the housing tube. This detaches the keeper tubes 47 from the housing tube 49 thereby allowing the surfaces to which the keeper 43 and housing 41 are attached to separate.

Figure 6:
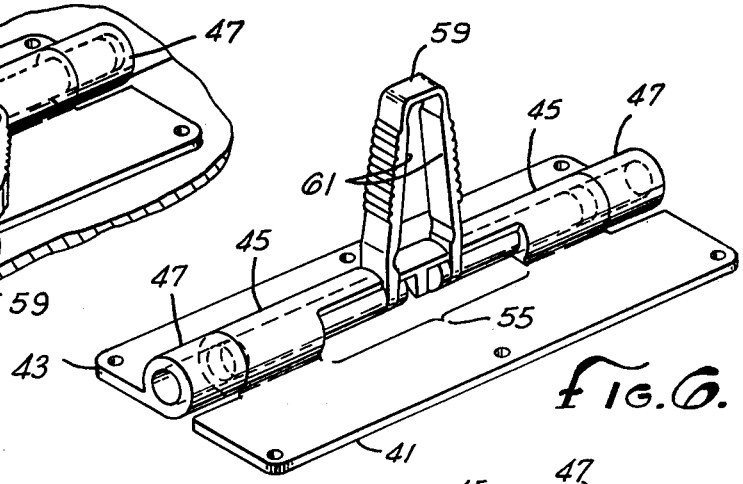

The pinched leg portions 61 of the spring/actuator can then be rotated roughly 90° about an axis through the center of the housing tube 49 as shown in FIG. 6. A portion of each leg portion 61 of the spring actuator 59 is now in each of the radial portions 57 of the lateral housing tube opening. When the pinched leg portions 61 are released, a portion of each of said leg portions quickly abuts against an edge of the housing tube 45 at the outer end of each radial portion 57. The spring/actuator is held in such a position as shown in FIG. 6 by its expansion spring force pushing the leg portions 61 against the housing tube edges. By such easy operations one may quickly release or attach two adjacent panels.

A third preferred embodiment of the invention is shown in FIGS. 11–14. This embodiment is similar in structure and operation to the second preferred embodiment. As in the second preferred embodiment there is a housing 65 with an edge portion in the form of a hollow housing tube 67. The housing tube 67 has a lateral opening with an axial portion 68 and two radial portions 71. A thin wall 70 divides the housing tube 67 across the housing tube axis and below each radial portion 71. A keeper 73 has edge end portions in the form of hollow keeper tubes 77 which fit against each end of the housing tube 67 and align axially therewith to form an extended hollow tube. A pin 79 slides within each half end of this extended tube. Each pin has a spring/actuator end 81 with a radial groove 82 in its exterior surface.

The spring/actuator 83 of this third preferred embodiment differs from the spring/actuator previously discussed in that it is roughly W-shaped, with an extension piece 85 between the inner top of each V-shaped portion 87 of the W-shaped spring/actuator 83. This extension piece 85 allows this embodiment to be relatively longer than the other embodiments. The extension piece 85 has a protruding portion 86 which protrudes from the center of said extension piece along its length. Each V-shaped portion 87 has two leg portions 89, the outer leg portion ending in a foot in the form of clipping jaws 91.

This preferred embodiment operates similarly to the other embodiments discussed. A pin 79 is slid, spring/actuator end 81 first, into each end of the housing tube 67. The spring/actuator extension piece 85 fits into the center portion of the hollow housing tube 67 between each thin wall 70. These walls 70 prevent the spring from sliding in the housing tube 67. A foot 91 of the spring/actuator 83 clips onto the spring/actuator end 81 of each pin 79 and around the radial groove 82 on said ends. The outer legs of the spring/actuator are pinched toward each other thereby pulling the pins 79 entirely into the housing tube 67. The keeper 73 is fitted next to the housing 65 with the keeper tubes 77 fitting against the ends of the housing tube 67 to thereby form an extended hollow tube. The keeper 73 and housing 65 are attached to respective adjacent surfaces. When the pinched leg portions of the spring/actuator are released the expansion spring force of the spring/actuator 83 pushes each pin partially beyond each end of the housing tube and partially into a respective keeper tube 77. Thus, the pins attach the keeper 73 and housing 65 and latch together any surfaces to which said keeper 73 and housing 65 are attached. The invention also serves as a hinge as previously discussed re the second preferred embodiment.

Figure 11:
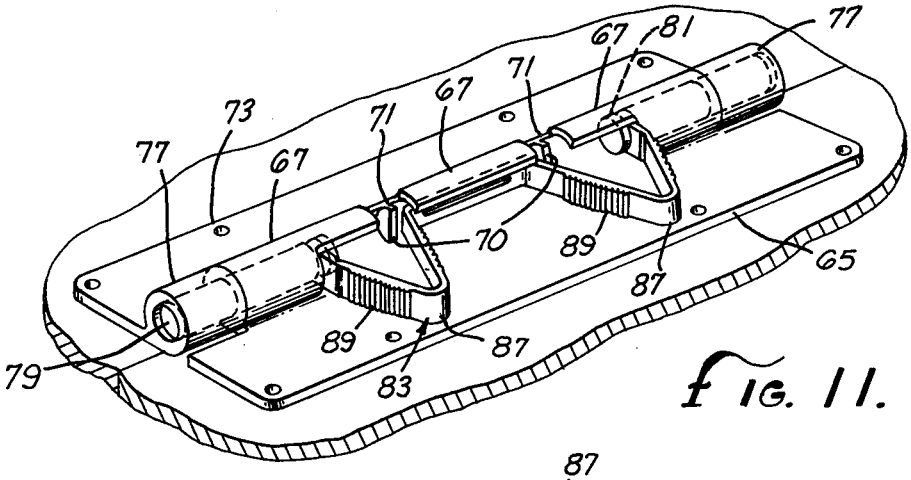
FIGS. 11, 12 and 13 are side elevational views of a third exemplary version of the invention.
Figure 13:
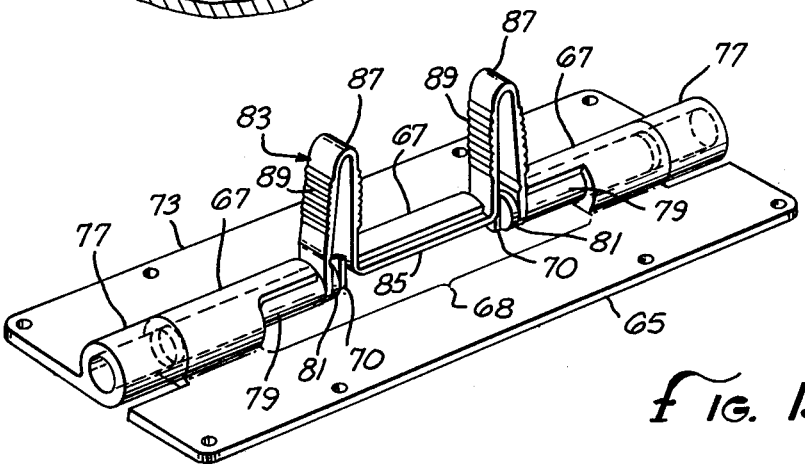
Figure 12:
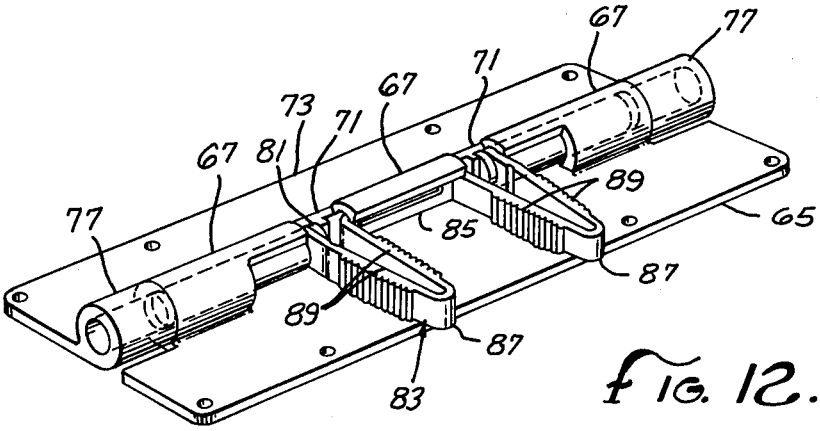

This preferred embodiment functions similarly to the other preferred embodiments in that when the spring/actuator 83 is in a first position as shown in FIG. 11 the spring/actuator 83 forces the attached pins 79 partially out of the housing tube 67 and partially into the keeper tubes 77. The spring expansion force pushes a portion of each outer leg portion of the spring/actuator 83 against an edge of the housing tube at the outer edges of the axial portion 68 of the lateral tube opening. The pins 79 are thus held extended and the invention can serve as a hinge or latch.

When the outer leg portions of the spring/actuator are pinched towards each other into a second position (shown in FIG. 12) the pins 79 are retracted entirely within the housing tube 67 thereby detaching the housing 65 from the keeper 73. From this position the spring/actuator 83 is rotated roughly 90° as in FIG. 13 such that a portion of each leg portion 89 rests in a radial portion 71 of the lateral groove opening. Portions of the two leg portions of each V-shaped portion 87 fit into respective radial portions 71 one leg on each side of the respective thin housing tube wall 70. When the spring/actuator 83 is released the spring expansive force pushes each outer leg portion against an edge of the housing tube 67. The pins 79 are now locked entirely within the housing tube 67 allowing easy separation of the housing 65 and keeper 73 and any surfaces to which said housing 65 and keeper are attached.

While preferred embodiments of the present invention have been disclosed, numerous alternatives and equivalents which do not depart from the spirit of the invention will occur to those skilled in the art given the benefit of the present teachings, and these alternatives and equivalents are intended to be included herein.

What is claimed is:

1. A quick release hinge/latch comprising
a housing having a first tube thereon;
a pin adapted to slide within said first tube; and
a flat spring having a first end fixed relative to said housing and a second end fixed to said pin, said flat spring biasing said pin axially outwardly of said first tube and extending laterally outwardly of said tube from each said end of said flat spring for manual gripping between said ends laterally outwardly of said tube to compress said flat spring and retract said pin into said first tube.

2. The quick release hinge/latch of claim 1 further comprising
a keeper having a second tube adapted to receive said pin therein when said pin is outwardly of said first tube.

3. The quick release hinge/latch of claim 1 wherein said flat spring is C-shaped.

4. The quick release hinge/latch of claim 3 wherein said flat spring has serrated surfaces on the portions of said flat spring extending laterally outwardly of said tube.

5. The quick release hinge/latch of claim 3 wherein said first end is pivotally mounted about a first axis and said second end is pivotally mounted about a second axis coincident with said first axis.

6. The quick release hinge/latch of claim 5 wherein said first and second ends of said flat spring each have a set of jaws, said pin has a first radial groove in one end thereof, and said first tube has a second radial groove in one end thereof, one of said sets of jaws being adapted to fit over and attach to said first radial groove and the other of said sets of jaws being adapted to fit over and attach to said second radial groove.

7. The quick release hinge/latch of claim 1 wherein said first tube includes a lateral opening having an axially extending portion through which said second end extends to said pin.

8. The quick release hinge/latch of claim 7 wherein said lateral opening has a radially extending portion adapted to receive said second end of said spring.

9. A quick release hinge/latch comprising a housing having a first tube thereon, said first tube including a lateral opening having an axially extending portion;

a pin adapted to slide within said first tube; and a C-shaped flat spring having a first end pivotally mounted about a first axis fixed relative to said housing and a second end pivotally mounted to said pin about a second axis coincident with said first axis and extending through said axially extending portion of said lateral opening in said first tube, said flat spring biasing said pin axially outwardly of said first tube and extending laterally outwardly of said tube from each said end of said flat spring for manual gripping between said ends laterally of said tube to compress said flat spring and retract said pins into said first tube.

10. The quick release hinge/latch of claim 9 wherein said lateral opening has a radially extending portion adapted to receive said second end of said spring when said spring is rotated from said axially extending portion.

11. The quick release hing/latch of claim 9 further comprising a keeper having a second tube thereon adapted to receive said pin therein when said pin is outwardly of said first tube.

12. The quick release hinge/latch of claim 9 wherein said flat spring has serrated surfaces to allow gripping of said spring to compress said spring and retract said pin into the first tube.

13. The quick release hinge/latch of claim 9 wherein said first and second ends of said flat spring each have a set of jaws, said pin has a first radial groove in one end thereof, and said first tube has a second radial groove in one end thereof, one of said sets of jaws being adapted to fit over and attach to said first radial groove and the other of said sets of jaws being adapted to fit over and attach to said second radial groove.

14. A quick release hinge/latch comprising a housing having a first tube thereon;

pins adapted to slide within said first tube; and a flat spring having a first end fixed to a first said pin and having a second end fixed to a second said pin, said flat spring biasing said first and second pins axially outwardly of said first tube and extending laterally outwardly from said tube from each said end of said flat spring for manual gripping between said ends laterally outwardly of said tube to compress said flat spring and retract said pins into said first tube.

15. The quick release hinge/latch of claim 14 wherein said flat spring is C-shaped.

16. The quick release hinge/latch of claim 14 wherein said flat spring is W-shaped.

17. The quick release hinge/latch of claim 14 wherein said first end of said flat spring is pivotally mounted about a first axis and said second end of said flat spring is pivotally mounted about a second axis coincident with said first axis.

18. The quick release hinge/latch of claim 17 wherein said first and second ends of said flat spring each have a set of jaws, said first pin has a first radial groove in one end of said first pin and said second pin has a second radial groove in one end of said second pin, one set of said jaws adapted to fit over and attach to said first radial groove and the other of said set of jaws adapted to fit over and attach to said second radial groove.

19. The quick release hinge/latch of claim 14 wherein said first tube includes two lateral openings having axially extending portions through which said ends of said flat spring extend to said pins.

20. The quick release hinge/latch of claim 19 wherein said lateral openings have radially extending portions adapted to receive the ends of said flat spring with said flat spring compressed to retract said pins into said tube.

21. A quick release hinge/latch for connecting a first surface and a second surface, comprising a housing adapted to attach to the first surface and having an edge portion in the form of a housing tube;

a pin adapted to slide within said housing tube and further adapted to slide partially beyond one end of said housing tube to a first position to removably attach said housing to the second surface;

a flat spring/actuator with two ends, one of said ends being attached to said housing and one of said ends being attached to said pin, said pin and said first spring/actuator being arranged such that said flat spring/actuator can removably hold said pin partially extending beyond said housing tube in said first position, said housing tube including an opening with an axial portion and a radial portion, said axial portion being constructed and arranged to receive a portion of said flat spring/actuator and allow movement of said portion of said flat spring/actuator to said first position and to a second position with said flat spring/actuator further compressed to withdraw said pin entirely into said housing tube to thereby detach said housing tube from the second surface, said radial portion being constructed and arranged to receive a portion of said flat spring/actuator in a third position within said radial portion of said opening to hold said pin detached from said second surface when said flat spring/actuator is rotated about an axis through the center of said housing tube.

22. A quick release hinge/latch for connecting a first surface and a second surface, comprising a housing adapted to attach to the first surface and having an edge portion in the form of a housing tube;

a pin adapted to slide within said housing tube and further adapted to slide partially beyond one end of said housing tube to a first position to removably attach said housing to the second surface;

a flat spring/actuator with two ends, one of said ends being attached to said housing and one of said ends being attached to said pin, said pin and said flat spring/actuator being arranged such that said flat spring/actuator can removably hold said pin partially extending beyond said housing tube in said first position, said flat spring/actuator having serrated surfaces to allow gripping thereof to compress said flat spring/actuator and retract said pin into said housing tube.

23. A quick release hinge/latch for connecting a first surface and a second surface, comprising a housing adapted to attach to the first surface and having an edge portion in the form of a housing tube;

a pin adapted to slide within said housing tube and further adapted to slide partially beyond one end of said housing tube to a first position to removably attach said housing to the second surface;

a flat spring/actuator with two ends, one of said ends being attached to said housing and one of said ends being attached to said pin, said pin and said flat spring/actuator being arranged such that said flat spring/actuator can removably hold said pin partially extending beyond said housing tube in said first position, said flat spring/actuator having two ends, each one of said ends having jaws, said pin having a first radial groove and said housing tube having a second radial groove, one set of said jaws being adapted to fit over and attach to said first radial groove and the other set of said jaws being adapted to fit over and attach to said second radial groove.

24. A quick release hinge/latch for connecting a first surface and a second surface, comprising a housing adapted to attach to the first surface and having an edge portion in the form of a housing tube having an axis, said housing tube having a lateral opening;

a keeper adapted to attach to the second surface and having an edge portion in the form of a keeper tube adapted to correspond and align with said housing tube;

a pin adapted to slide within said housing tube and partially beyond said housing tube and partially into said keeper tube;

a C-shaped flat spring/actuator having two ends, one end of which attaches to an end of said pin communicating thereto through said lateral opening, said spring/actuator being constructed and arranged such that when in a first position said spring/actuator holds said pin partially extending into said keeper tube thereby removably connecting said keeper and housing, while when in a second position said spring/actuator retracts said pin entirely into the housing tube thereby detaching said keeper and housing;

said lateral opening further having a radial portion such that when said spring/actuator is rotated about the axis of said housing tube from said second position and into a third position, a portion of said spring/actuator rests within said radial portion to thereby hold said pin retracted entirely into said housing tube to thereby facilitate detachment of said housing from said keeper;

said spring/actuator ends each having jaws, said pin having a first radial groove in one end of said pin and said housing having a second radial groove in one end of said housing tube, one set of said jaws being adapted to fit over and removably attach to said first radial groove and the other set of said jaws being adapted to fit over and removably attach to said second radial groove, said spring/actuator further having serrated surfaces to allow gripping of said spring/actuator to compress or release said spring/actuator and to move said spring/actuator between said first, second and third positions.

25. A quick release hinge/latch for connecting a first surface and a second surface, comprising a housing adapted to attach to the first surface and having an edge portion in the form of a housing tube with two ends, said housing tube having a lateral opening;

two pins adapted to slide within said ends of said housing tube and further adapted to slide partially beyond each of said ends of said housing tube to removably attach said housing to the second surface;

a flat spring/actuator with two leg portions, each leg portion having an end portion, each said end portion being attached to an end of each of said pins communicating thereto through said lateral opening, said pins and said flat spring/actuator being arranged such that said flat spring/actuator holds each of said pins partially extended beyond each of said housing tube ends when in a first position to removably attach said housing to said second surface when said spring/actuator leg portions are pressed toward each other to move said spring/actuator into a second position with said pins retracted entirely into said housing tube to detach said housing from the second surface;

said lateral opening in said housing tube further having a radial portion arranged to receive said end portions of said leg portions of said spring/actuator when said spring/actuator is rotated about the axis of said housing tube from said second to a third position to thereby hold said pins retracted entirely within said housing tube.

26. A quick release hinge/latch for connecting a first surface and a second surface, comprising a housing adapted to attach to the first surface and having an edge portion in the form of a housing tube with two ends, said housing tube having a lateral opening;

two pins adapted to slide within said ends of said housing tube and further adapted to slide partially beyond each of said ends of said housing tube to removably attach said housing to the second surface;

a flat spring/actuator with two leg portions, each leg portion having an end portion, each said end portion being attached to an end of each of said pins communicating thereto through said lateral opening, said pins and said flat spring/actuator being arranged such that said flat spring/actuator holds each of said pins partially extending beyond each of said housing tube ends when in a first postion to removably attach said housing to said second surface when said spring/actuator leg portions are pressed toward each other to move said spring/actuator into a second position with said pins retracted entirely into said housing tube to detach said housing from the second surface;

said flat spring/actuator having serrated surfaces to allow gripping of said spring/actuator leg portions to compress said spring/actuator and retract said pins into said housing tube.

27. A quick release hinge/latch for connecting a first surface and a second surface, comprising a housing adapted to attach to the first surface and having an edge portion in the form of a housing tube with two ends, said housing tube having a lateral opening;

two pins adapted to slide within said ends of said housing tube and further adapted to slide partially beyond each of said ends of said housing tube to removably attach said housing to the second surface;

a flat spring/actuator with two leg portions, each leg portion having an end portion, each said end portion being attached to an end of each of said pins communicating thereto through said lateral opening, said pins and said flat spring/actuator being arranged such that said flat spring/actuator holds each of said pins partially extending beyond each of said housing tube ends when in a first position to removably attach said housing to said second surface when said spring/actuator leg portions are pressed toward each other to move said spring/actuator into a second position with said pins retracted entirely into said housing tube to detach said housing from the second surface;

each of said pins having an inner end having a radial groove, said flat spring/actuator having jaws on each said end adapted to fit over and removably attach to said radial grooves.

28. A quick release hinge/latch for connecting a first surface and a second surface, comprising a housing adapted to attach to the first surface and having an edge portion in the form of a housing tube with two ends, said housing tube further having a lateral opening having radial groove portions;

a keeper adapted to attach to the second surface and having an edge portion in the form of at least two keeper tubes, said keeper tubes adapted to correspond and align axially with said housing tube;

at least two pins adapted to slide within the ends of said housing tube and further adapted to slide partially beyond the ends of said housing tube and partially into said keeper tubes to removably attach said housing to said keeper;

a flat spring/actuator with two legs each with a leg end portion, said leg end portion of each of said legs being attached to an end of each of said pins communicating thereto through said opening, said spring/actuator being arranged such that said spring/actuator, when in a first position, holds each of said pins partially extending into said keeper tubes thereby attaching said keeper and said housing and, when said spring/actuator is compressed by pushing said spring/actuator legs toward each other to move said spring/actuator to a second position, said spring/actuator withdraws said pins entirely into said housing tube to thereby detach said housing and said keeper and, when said spring/actuator is rotated from said second position to a third position, said legs of said flat spring/actuator lock into said radial groove portions of said opening to thereby hold said pins retracted from said keeper tubes.

29. The hinge/latch of claim 28 wherein said flat spring/actuator is C-shaped.

30. The hinge/latch of claim 28 wherein said flat spring/actuator is W-shaped.

* * * * *

UNITED STATES PATENT AND TRADEMARK OFFICE

CERTIFICATE OF CORRECTION

PATENT NO. : 4,455,711

DATED : June 26, 1984

INVENTOR(S) : John P. Anderson

It is certified that error appears in the above—identified patent and that said Letters Patent is hereby corrected as shown below:

In column 8, line 30, delete "first" and insert therefor -- flat --.

Signed and Sealed this

*Fourth* Day of *December 1984*

[SEAL]

*Attest:*

GERALD J. MOSSINGHOFF

*Attesting Officer*

*Commissioner of Patents and Trademarks*